US005944584A

United States Patent [19]

Toyama

[11] Patent Number: 5,944,584

[45] Date of Patent: Aug. 31, 1999

[54] APPARATUS AND METHOD FOR CHAMFERING WAFER WITH LOOSE ABRASIVE GRAINS

[75] Inventor: Kohei Toyama, Shirakawa, Japan

[73] Assignee: Shin-Estu Handotai Co., Ltd., Tokyo, Japan

[21] Appl. No.: 08/914,751

[22] Filed: Aug. 20, 1997

[30] Foreign Application Priority Data

Aug. 27, 1996 [JP] Japan ..... 8-244184

[51] Int. Cl.[6] ..... B24B 1/00

[52] U.S. Cl. ..... 451/41; 451/285; 451/43

[58] Field of Search ..... 451/28, 36, 37, 451/41, 43, 44, 60, 87, 88, 285, 288, 289, 286, 287, 547, 548; 125/13, 12, 11.15, 11.18, 18, 13.01

[56] References Cited

U.S. PATENT DOCUMENTS

| | | | |
|---|---|---|---|
| 888,129 | 5/1908 | Tone | 451/547 |
| 1,736,355 | 11/1929 | Mosher | 451/547 |
| 3,916,579 | 11/1975 | Waller et al. | 451/547 |
| 4,344,260 | 8/1982 | Ogiwara | 451/44 |
| 4,718,202 | 1/1988 | Worsham | 451/44 |
| 5,149,337 | 9/1992 | Watanabe | 451/43 |
| 5,274,959 | 1/1994 | Dyer et al. | 451/44 |
| 5,295,331 | 3/1994 | Honda et al. | 451/44 |
| 5,317,836 | 6/1994 | Hasegawa et al. | 451/44 |
| 5,476,413 | 12/1995 | Hasegawa et al. | 451/44 |
| 5,609,514 | 3/1997 | Yasunaga et al. | 451/44 |
| 5,658,185 | 8/1997 | Morgan, III et al. | 451/288 |
| 5,658,189 | 8/1997 | Kagamida | 451/44 |
| 5,664,990 | 9/1997 | Adams et al. | 451/287 |
| 5,725,414 | 3/1998 | Moinpour et al. | 451/44 |

FOREIGN PATENT DOCUMENTS

| | | |
|---|---|---|
| 0 552 989 | 7/1993 | European Pat. Off. . |
| 0 607 940 | 7/1994 | European Pat. Off. . |
| 0 663 264 | 7/1995 | European Pat. Off. . |
| 32 18 009 | 11/1983 | Germany . |
| WO 91 14075 | 9/1991 | WIPO . |

*Primary Examiner*—David A. Scherbel
*Assistant Examiner*—Derris Holt Banks
*Attorney, Agent, or Firm*—Oliff & Berridge, PLC

[57] ABSTRACT

Dispersion of cracks in a crack layer across a ground surface is reduced in chamfering a semiconductor silicon wafer. The semiconductor silicon wafer is clamped by a clamp device, which is freely rotated and a polisher having the shape of a ring built in a polishing device, which is freely rotated, is disposed in a place, the polisher having a periphery shaping edge on a peripheral side surface, wherein the polishing device is moved in a radial direction of the wafer so as to position the periphery shaping edge close to the periphery of the wafer, and the wafer and the polishing device are rotated relatively to each other, while slurry containing suspension of abrasive grains is supplied to a narrow space therebetween from a slurry supply nozzle.

19 Claims, 8 Drawing Sheets

APPARATUS AND METHOD FOR CHAMFERING WAFER WITH LOOSE ABRASIVE GRAINS

BACKGROUND OF THE INVENTION

1. Field of the Invention

The present invention relates to improvements in an apparatus and method for chamfering, for example, a semiconductor silicon wafer with loose abrasive grains.

2. Related Art

The periphery of, for example, a semiconductor silicon wafer (hereinafter referred simply to as wafer) has been chamfered, heretofore, in order to prevent dust generation when a wafer is supplied as a starting material for a highly integrated super LSI or to prevent chipping, flaking away and the like in a previous process thereof.

A recent chamfering process, for example, wherein high-precision mirror-polishing is performed, has been generally conducted stepwise in three steps of first, second and final. Such steps respectively correspond to the three steps of rough polishing, middle polishing and fine polishing in a polishing process on a major surface of a wafer. In the chamfering process, grinding with fixed grains, such as a grinding stone, are generally applied to the first and second steps and buff polishing is applied to the final step.

On the other hand, a method for chamfering a wafer by acid etching with a hydrofluoric/nitric acid-base etchant is known other than the above mentioned grinding and polishing using abrasive grains. The acid etching method has a fault that it is difficult to control a profile of a chamfer. Therefore, fixed abrasive grains are generally used in the first and second grinding steps in order to solve the fault.

However, when fixed abrasive grains are used in the first and second steps, cracks in a crack layer (damaged layer) produced in the surface region of a ground surface show a large degree of dispersion in penetration depth if they are examined microscopically, which is, with the naked eye, observed as a striation pattern of a surface roughness on a main surface and causes non-uniformity in sectional profile of a chamfer. That is, the use of fixed abrasive grains wrongly affects dispersion of the quality. Diamond abrasive grains, which are generally used as fixed grains, have a problem that a crack layer locally penetrates to a depth and, as a result, dispersion in surface roughness produces a pattern of striation, too.

Many countermeasures, such as to process for a longer time with finer grains or to process in an increased number of steps, have been tried to minimize dispersion in penetration depth of cracks in the crack layer, but the trials have been failed owing to reduction in working efficiency and a wrong influence on productivity.

Under such circumstances, a processing technique has been desired, which gives less dispersion in penetration depth of cracks in a crack layer in each of the first and second chamfering steps, that is one which does not locally produce a crack or cracks with abnormally greater penetration depth than the rest has been desired. It is natural that improvement of working efficiency should be secured in the desired processing technique.

SUMMARY OF THE INVENTION

A first aspect of the present invention is directed to an apparatus for chamfering a periphery of a wafer, which comprises: a polisher having a circular periphery in outward appearance, a periphery shaping edge being formed on the circular periphery and the edge having a desired cross-sectional profile; a first relatively moving mechanism which moves the polisher and the wafer relatively away from or toward each other in a radial direction of the wafer so as to move the periphery shaping edge relatively away from or toward the periphery of the wafer; a slurry supply mechanism for supplying slurry containing suspended abrasive grains at a closest position between the polisher and the wafer; and a second relatively moving mechanism which moves the polisher and the wafer relative to each other in a tangential direction at the closest point to each other in the presence of the slurry therebetween.

Another aspect of the present invention is directed to a method for chamfering a periphery of a wafer, in which a periphery shaping edge of a polisher is shaped as a groove on the peripheral side surface of its own along the periphery, the slurry is sustained between the periphery shaping edge and the peripheral side surface of the wafer and both of them are moved relative to each other along the tangent in order to shape the periphery of the wafer in conformity with the sectional profile of the periphery shaping edge.

In this case, as to loose abrasive grains suspended in the slurry, fine grains of such a material as silicon carbide or alumina having a specified size distribution are preferred and as to a polisher, a polisher made of cast iron, stainless steel or one of kinds of alloy is preferred. A cross-sectional profile of the periphery shaping edge is so shaped that the sectional profile of a chamfered periphery of a wafer may be in conformity with a desired cross-sectional profile thereof after chamfering and the periphery shaping edge works as a so-called formed tool.

Grinding with loose abrasive grains, as described above, can prevent cracks in the crack layer from locally propagating into an abnormally large depth and thereby minimize dispersion in penetration depth of cracks over a ground surface.

A case where grinding is conducted with fixed abrasive grains will be discussed: For example, diamond abrasive grains in general up to # 2000 in size, except for such a special case as electrolytic in-process dressing, are put into practical use and a grinding speed (a work load against the abrasive grains) is decreased and a penetration depth of the crack layer is also diminished as grains finer in size are used. However, if some of fixed abrasive grains are separated off due to abrasion or the like, the crack layer has a chance to be locally deeper. Accordingly, it is conceived that even with the use of such finer diamond abrasive grains, dispersion in penetration depth of a crack layer across a ground surface becomes larger by a unstable cause as described above.

When loose abrasive grains are used as in a method according to the present invention, such a uncertain cause as separation-off of abrasive grains is not present and thereby a stabler processing than that with fixed abrasive grains can be attained.

According to a second aspect of the apparatus of the present invention, in the apparatus of the present invention, a second polisher may be used instead of the first polisher which has, as a periphery shaving edge, a concave circular arc portion globally in conformity with the curvature of a wafer to be chamfered and the periphery shaving edge also has a groove on the peripheral side surface along the arc whose cross-sectional profile is a desired profile of the chamfer of the wafer. In this case, the second polisher can realize an increased concurrent grinding area of the periphery of a wafer, as compared with the first polisher of an external shape of a simple circle and thereby working efficiency is improved.

According to a third aspect of the apparatus of the present invention, the second relatively moving mechanism comprises a wafer rotating mechanism, with which a wafer is rotated about its central axis, and a polisher rotating mechanism, with which a polisher is rotated about its central axis.

In this mechanism, if the wafer and polisher rotate their respective axes and the periphery of the wafer moves relative to the periphery shaping edge of the first polisher in a tangential direction at the closest point to each other, the entire periphery of the wafer can be chamfered with higher efficiency and in a shorter time using the entire length of the periphery shaping edge of the polisher.

In a fourth aspect of the apparatus of the present invention, a plurality of slits are formed at a constant distance between two adjacent slits across all the length of the periphery shaping edge in order to facilitate escaping off of a slurry from the periphery shaping edge. With a combination of such escaping-off slits of used slurry and replenishment of new slurry to the periphery shaping edge makes the working efficiency in the chamfering higher.

In a fifth aspect of the apparatus of the present invention, the slurry supply mechanism is preferably a nozzle for supplying slurry disposed near both of the periphery shaping edge and the periphery of the wafer. The nozzle of supplying slurry makes a structure of the slurry supply mechanism simpler, whereby the manufacturing and other costs thereof is reduced.

In a sixth aspect of the apparatus of the present invention, the slurry supply mechanism is constructed as paths inside the polisher and fore ends of the paths are directed to the periphery shaping edge and the paths have openings thereon. The slurry is supplied through the paths and a space around the polisher is effectively used and thus the apparatus for the chamfering becomes more compact as a whole.

In the seventh aspect of the apparatus of the present invention, the abrasive grains in the used slurry is recovered by means of an abrasive grain recovery system and separated from a medium of suspension. Thus recovered abrasive grains are re-used by again suspending them in a solution as the medium of suspension.

In the eighth aspect of the apparatus of the present invention, a fluid cyclone classifier is used as the abrasive grain recovery system. If abrasive grains, which have been included in the used slurry, are recovered in this way for the re-use, it is a factor of increasing efficiency of the process. If the recovery is conducted by the fluid cyclone classifier, the size distribution of recovered abrasive grains can be maintained as a constant one.

According to further aspect of the present invention, a method of the present invention is to effect chamfering by relative motions between the periphery shaping edge of a polisher and the periphery of a wafer in the presence of slurry therebetween, as described above. In a further aspect of the present invention, a plurality of wafers are disposed along the periphery of the polisher in a surrounding manner and the wafers are chamfered all concurrently or one by one in succession. When all the wafers are processed at the same time, the wafers are disposed around the periphery shaping edge respectively keeping adjacent positions thereto and, in this condition, are moved relative to the periphery shaping edge. On the other hand, when the wafers are chamfered successively, they are disposed along the periphery of the polisher in a spaced manner and moved in a radial direction of the wafer in succession one by one or in groups along the periphery of the polisher.

BRIEF DESCRIPTION OF THE DRAWINGS

The novel features which are considered characteristic of the present invention are set forth with particularity in the appended claims. The present invention itself, however, and additional objects and advantages thereof will best be understood from the following description of embodiments thereof when read in connection with the accompanying drawings, in which:

FIGS. 4(A) and 4(B) are structural views of a slurry supply mechanism, wherein FIG. 4(A) is a plan view and FIG. 4(B) is a partially sectional view in a thickness direction;

FIGS. 5(A) and 5(B) are structural views of another slurry supply mechanism, wherein FIG. 5(A) is a plan view and FIG. 5(B) is a partially sectional view in a thickness direction;

FIGS. 7(A) and 7(B) are structural views of another polisher having a circular arc portion, wherein FIG. 7(A) is a plan view and FIG. 7(B) is a sectional view in a thickness direction; and FIGS. 8(A) and 8(B) are structural views illustrating a fluid cyclone classifier, wherein FIG. 8(A) is a view as viewed from a side and FIG. 8(B) is a view as seen from above.

DETAILED DESCRIPTION OF THE INVENTION

Embodiments of the present invention are described in reference to the drawings.

Figure 1:
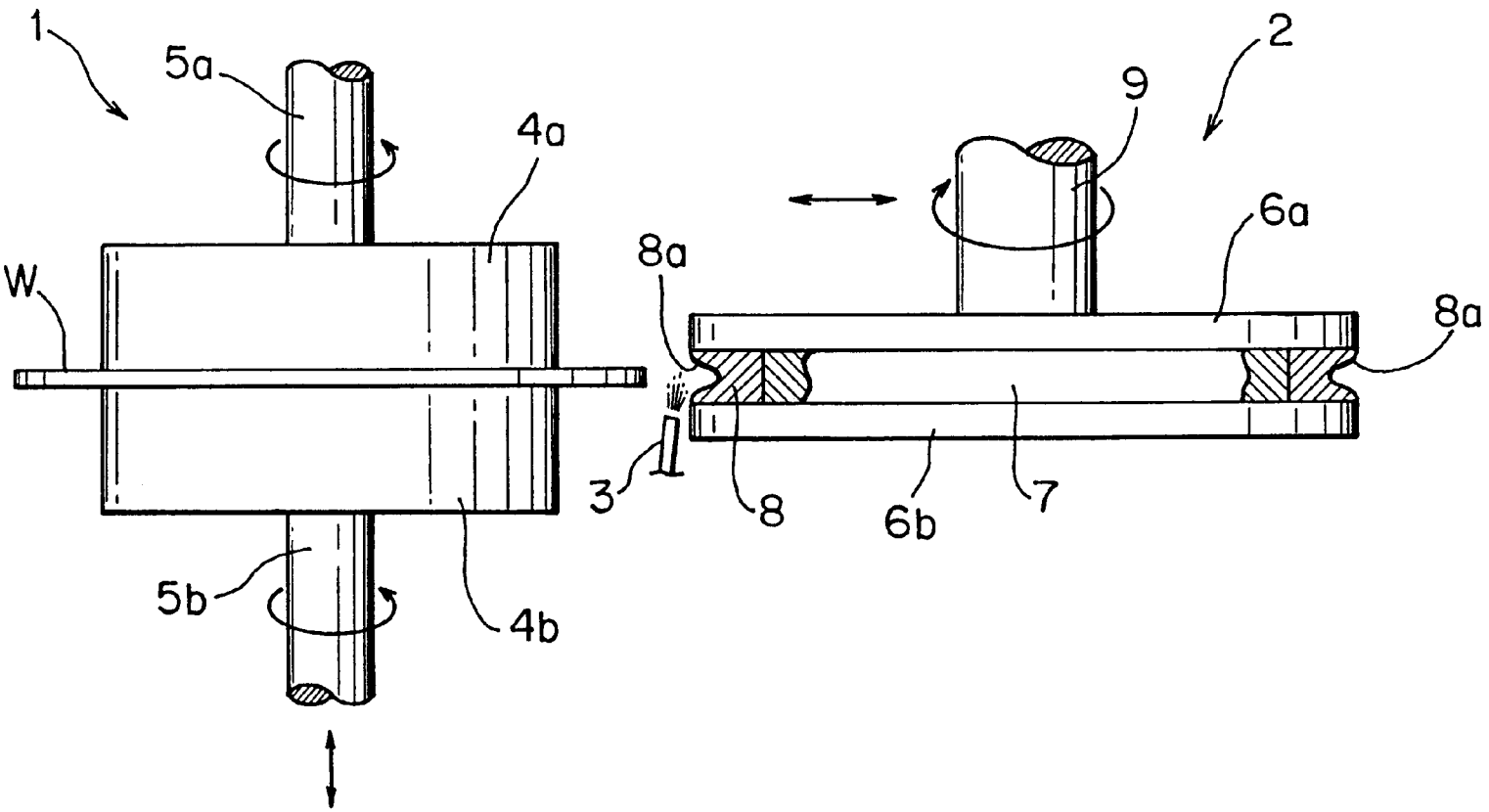
FIG. 1 is a schematic view, partly in section, of the configuration of main parts of an apparatus for chamfering a wafer of the present invention.
Figure 2:
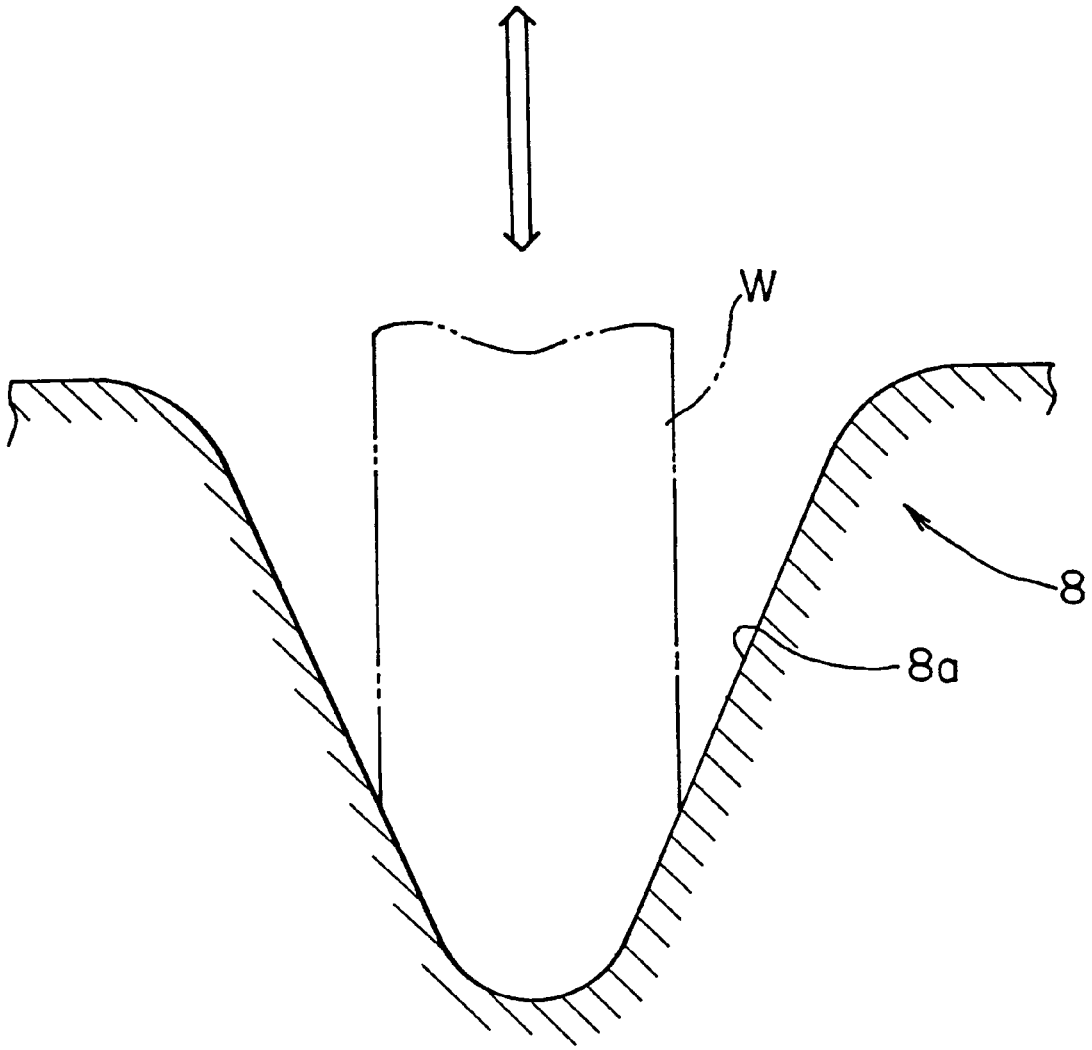
FIG. 2 is an enlarged view in section of an example of the periphery shaping edge of a polisher of the present invention.
Figure 3:
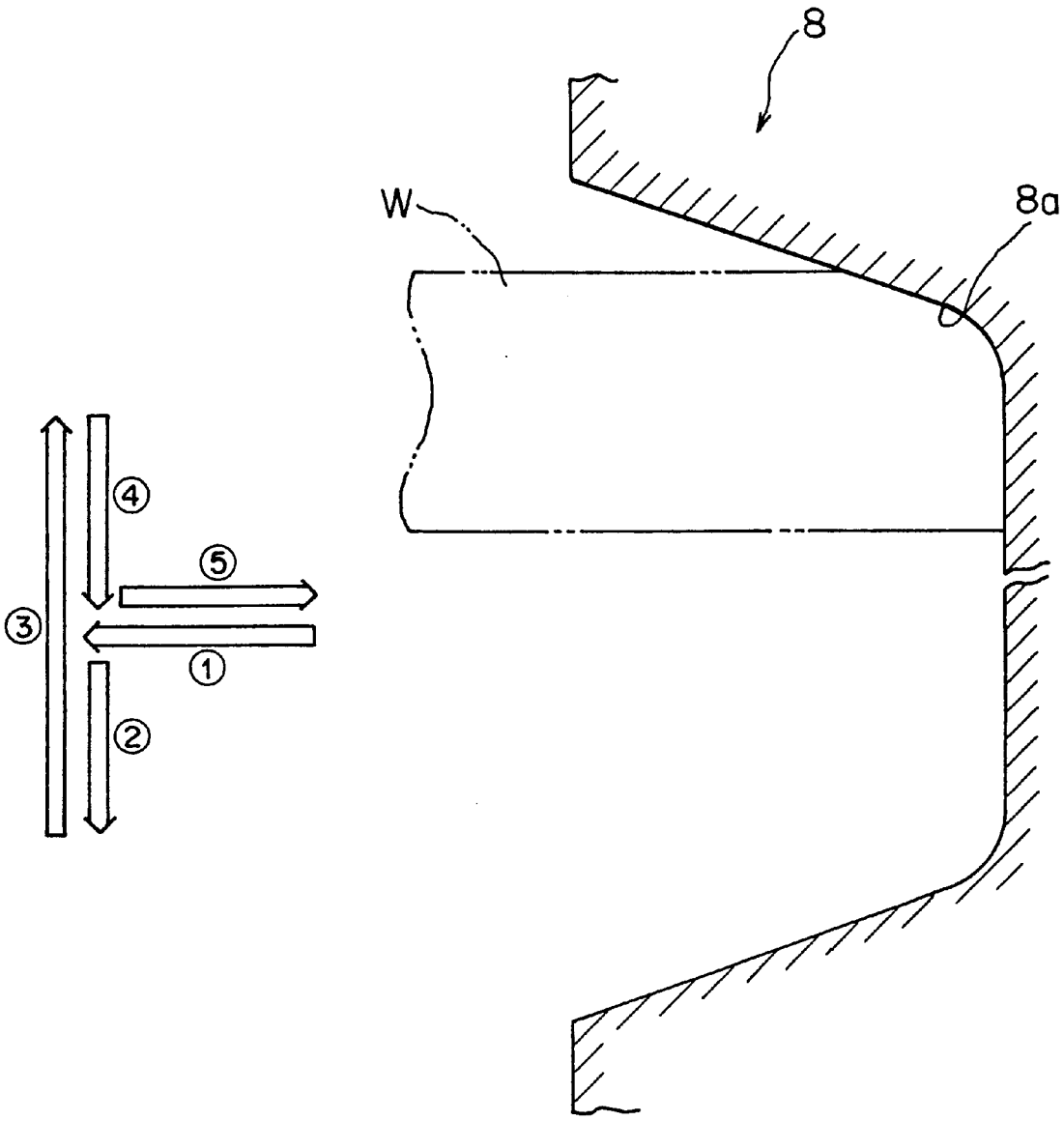
FIG. 3 is an enlarged view in cross-section of another example of the periphery shaping edge of a polisher of the present invention.
Figure 4A:
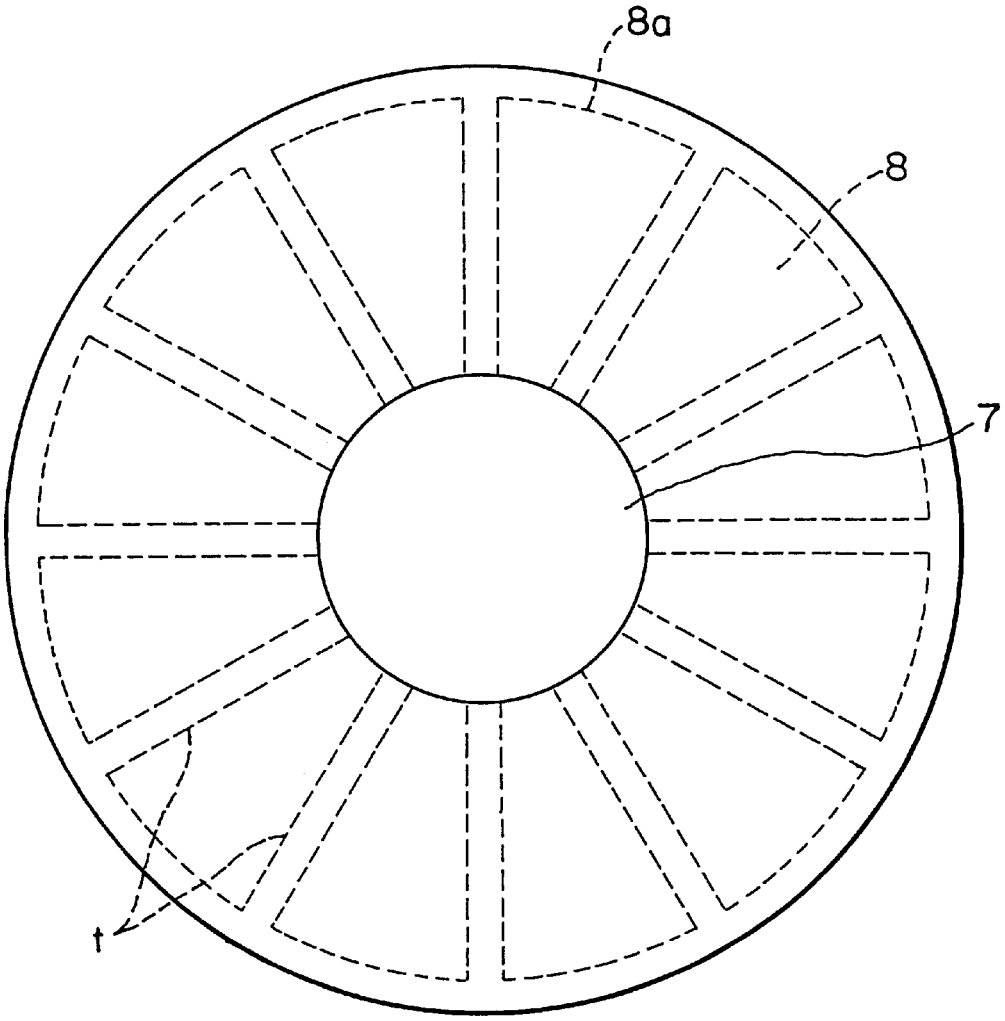
Figure 4B:
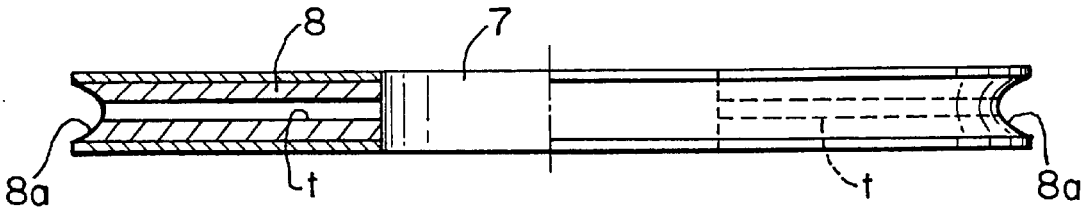
Figure 5A:
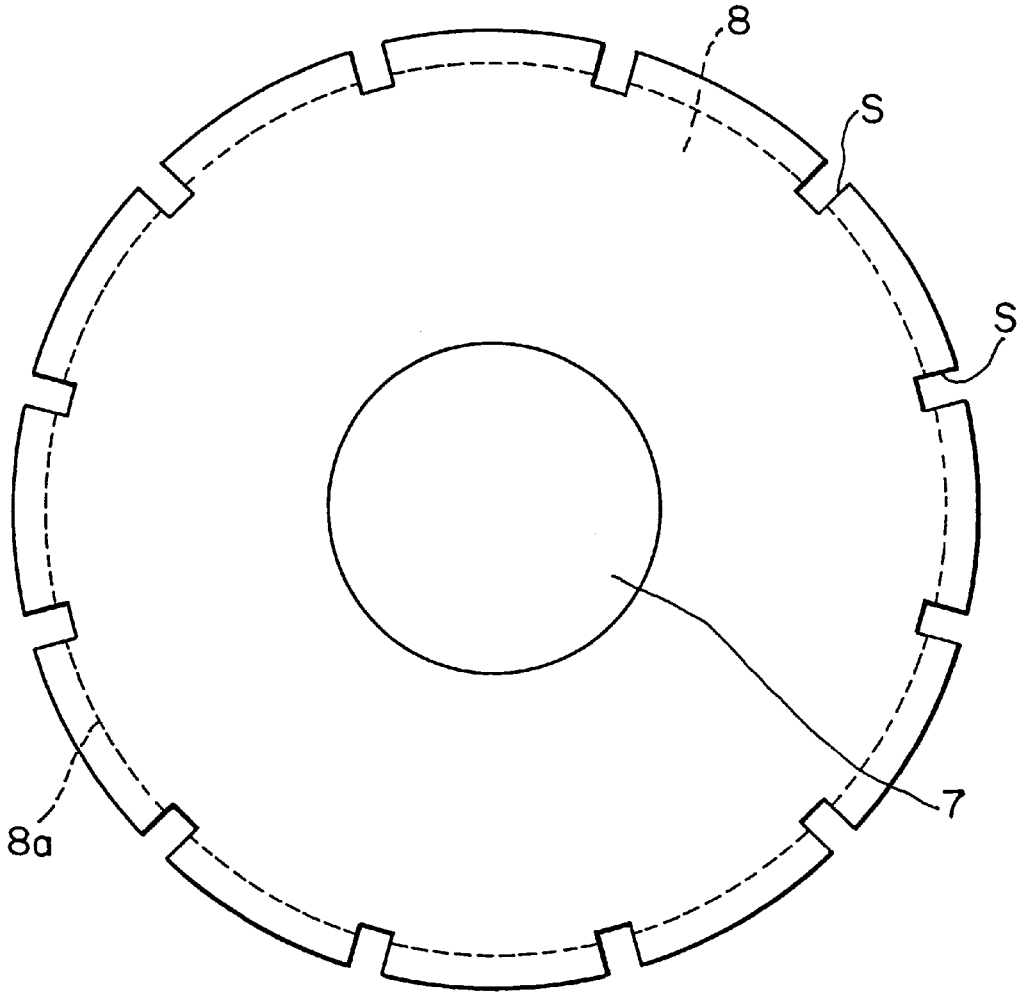
Figure 5B:
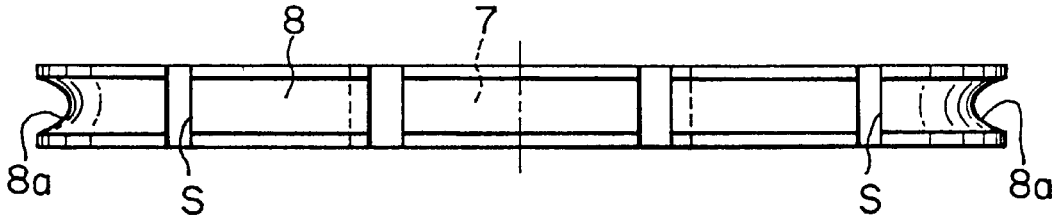
Figure 6:
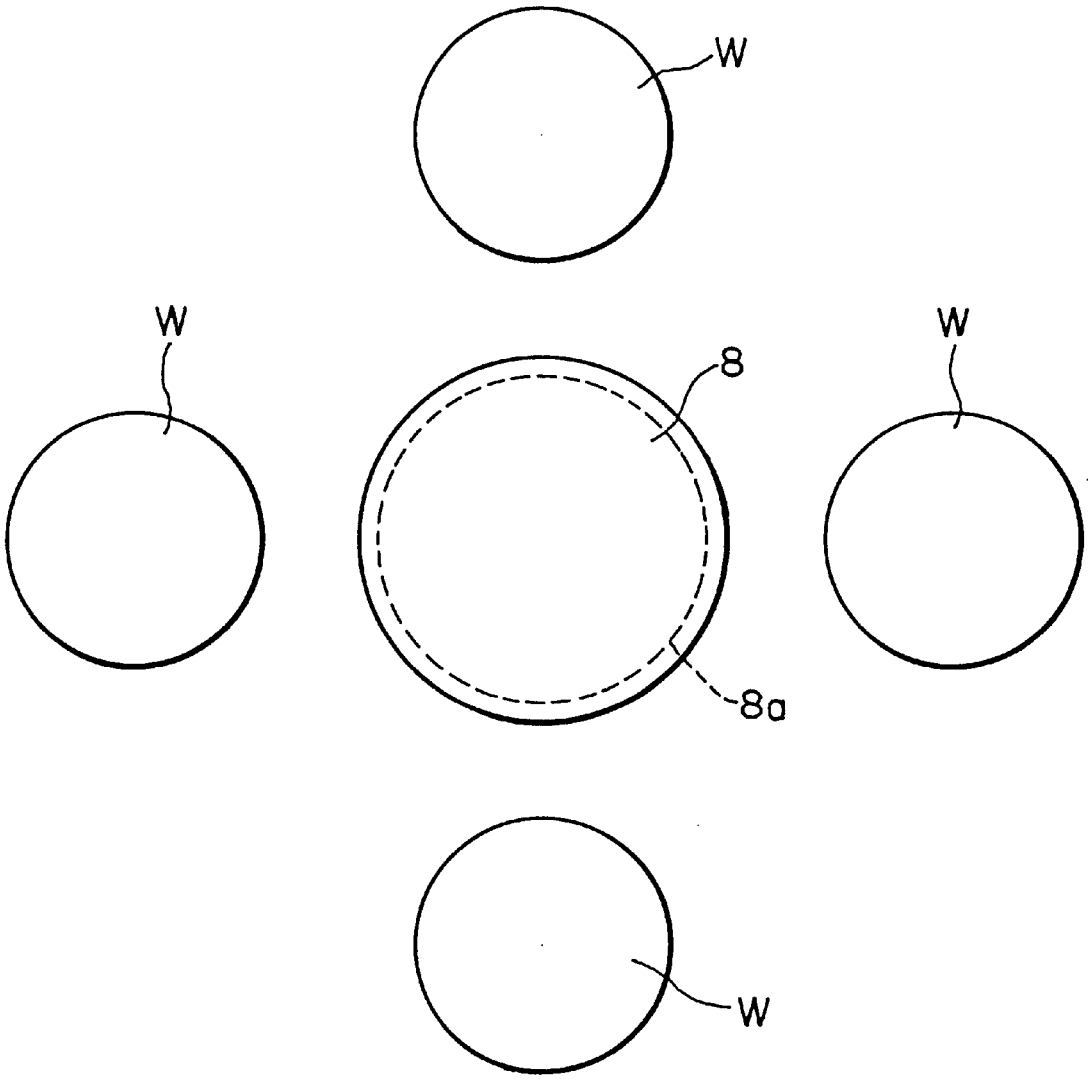
FIG. 6 is a view illustrating an arrangement of a plurality of wafers disposed along the periphery of a polisher.
Figure 7A:
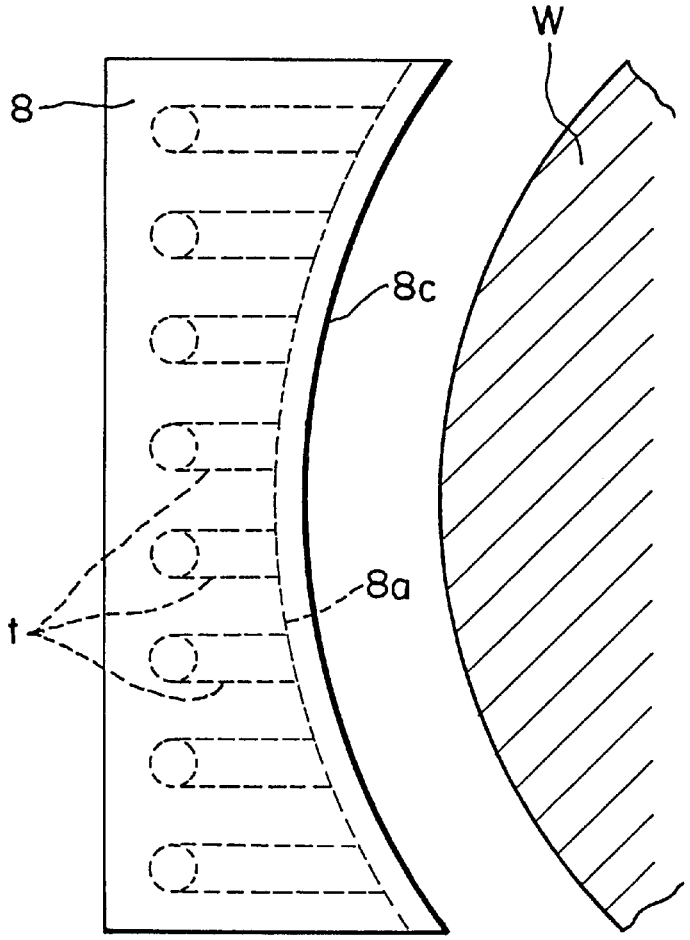
Figure 7B:
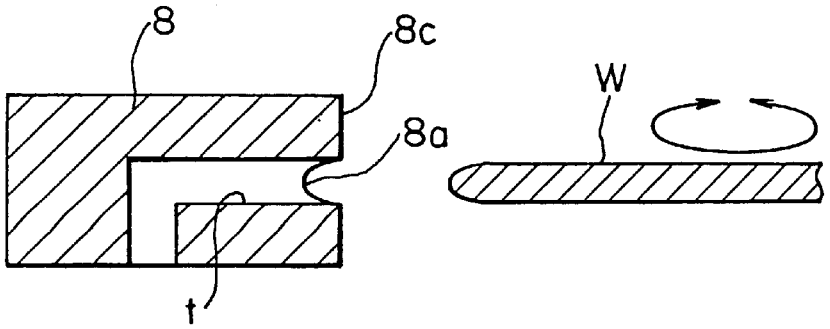
Figure 8A:
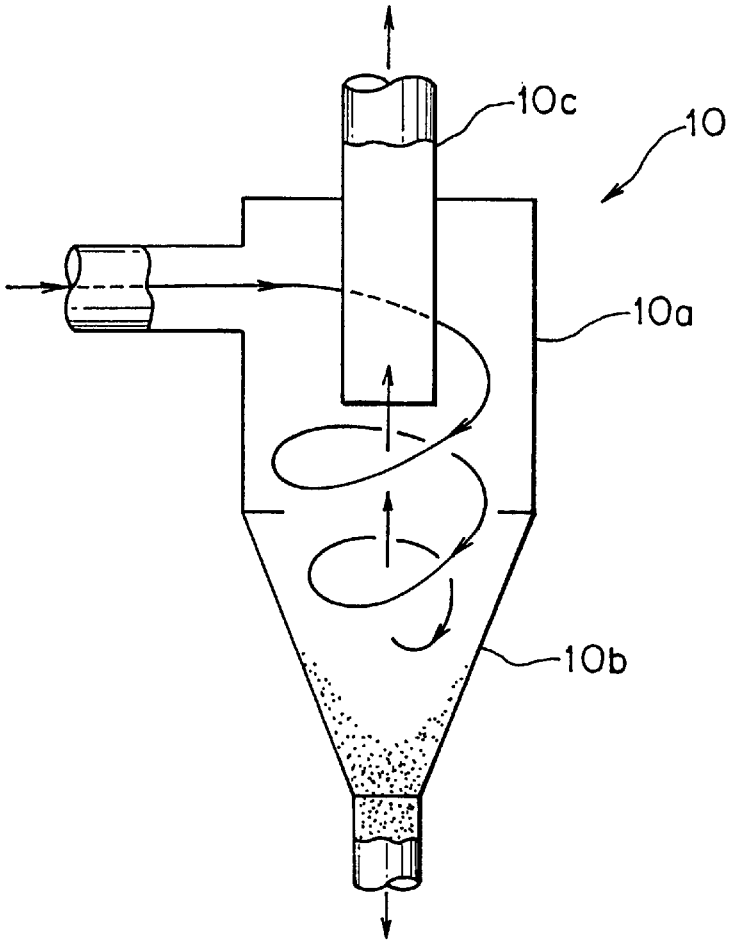
Figure 8B:
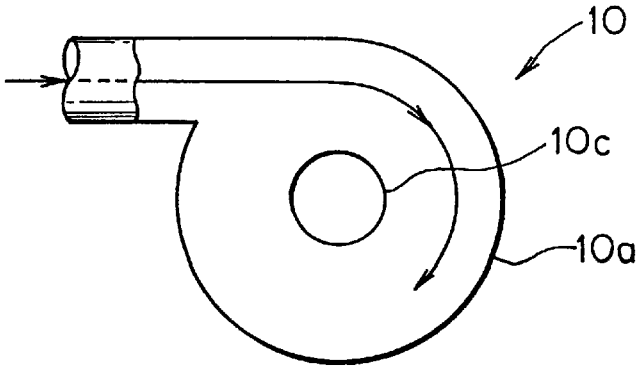

FIG. 1 is a schematic view of the configuration of main parts of an apparatus for chamfering a wafer of the present invention, FIG. 2 is an enlarged view in section of an example of the periphery shaping edge of a polisher of the present invention, FIG. 3 is an enlarged view in section of another example of the periphery shaping edge of a polisher of the present invention, FIGS. 4(A) and 4(B) are structural views of a slurry supply mechanism, FIGS. 5(A) and 5(B) are structural views of another slurry supply mechanism, wherein slits are formed along the periphery shaping edge, FIG. 6 is a view illustrating the arrangement of a plurality of wafers disposed along the periphery of a polisher, FIGS. 7(A) and 7(B) are structural views of another polisher having a circular arc portion, and FIGS. 8(A) and 8(B) are structural views illustrating a fluid cyclone classifier.

An apparatus for chamfering a wafer of the present invention is contrived so as to solve a problem that dispersion in penetration depth of cracks in a crack layer generated on a ground surface is increased, especially in the first and second steps of in a conventional chamfering process, when chamfering the periphery of a semiconductor silicon wafer is effected. The apparatus comprises, as shown in FIG. 1: a clamp device 1 for clamping a wafer W; a polishing device 2 for chamfering the periphery of a wafer W; a nozzle 3 for supplying slurry as a slurry supply mechanism, which supplies the slurry containing abrasive grains as suspension therein to an area in chamfering.

The clamp device 1 comprises: a pair of clamping members 4*a*, 4*b* holding the wafer W by pressing both surfaces; shafts 5*a*, 5*b* connecting with the clamping members 4*a*, 4*b* at respective centers thereof, wherein the shafts 5*a*, 5*b* are freely rotated about their respective central axes by means of a wafer rotating mechanism, not shown, and freely moved upwardly or downwardly by a vertically shifting mechanism, not shown.

The polishing device 2 comprises: a pair of side discs 6*a*, 6*b*; a core disc 7 sandwiched between the pair of side discs 6*a*, 6*b*; a polisher 8 of a ring like shape on the periphery of the core disc 7; a rotary shaft 9 connecting at the central portion of one of the side discs 6*a*, 6*b*; wherein the side discs 6*a*, 6*b*, core disc 7 and polisher 8 are combined as one body and the rotary shaft 9 is not only freely rotated about its central axis by a polisher rotating mechanism, not shown, but also freely movable in its radial direction by a first relatively moving mechanism, not shown.

A periphery shaping edge 8*a* having a shape of a groove is formed on the outer peripheral side surface of the polisher 8. The groove-like shape of the periphery shaping edge 8*a* is formed in conformity with a desired sectional profile of a chamfered periphery of the wafer W, as shown in FIG. 2. When the periphery of a wafer W and a periphery shaping edge 8*a* are positioned close to each other and moved relatively to each other at a closest point to each other with the presence of abrasive grains therebetween, then the periphery of the wafer W can globally be cut following the sectional profile of the periphery of the shaping edge 8*a*, which works as a formed tool during chamfering.

Material of the polisher 8 can be selected from a group consisting of cast iron, stainless steel and other alloys.

A nozzle 3 for supplying slurry as described above is arranged so as to have the slurry supplied between a periphery shaping edge 8*a* and the periphery of a wafer W, where the slurry is prepared by suspending fine abrasive grains with a predetermined size distribution in a grinding fluid (coolant) and the abrasive grains are of, for example, silicon carbide, alumina or the like.

In an apparatus for the chamfering as mentioned above, a wafer W is clamped with a clamp device 1 and thereafter a polishing device 2 is moved along a radial direction by a first relatively moving mechanism so that the peripheral side surface of the wafer W may approach close to the periphery shaping edge 8*a* of a polisher 8. At this point, slurry begins to be supplied from a supply nozzle 3 to the gap between the periphery shaping edge 8*a* and the peripheral side surface of the wafer W and, while the slurry is supplied, a clamp device 1 and the polishing device 2 are rotated about their respective central axes so as to have relative movements therebetween occur at the closest point of each other. On this occasion, if the periphery shaping edge 8*a* and the peripheral side surface of the wafer W are pressed toward each other by a first relatively moving mechanism, the peripheral side surface of the wafer W is, as shown in FIG. 2, chamfered in conformity with the sectional profile of the periphery shaping edge 8*a* by an action of loose abrasive grains.

If the chamfering is effected by means of this method, there does not happen a phenomenon of separating-off of abrasive grains from a grinding stone, which would happen in the case of grinding with fixed abrasive grains, and therefore no cracks locally propagate into a deeper position, that is, dispersion in penetration depth of cracks in a crack layer over a ground surface can be minimized.

The slurry supplied to a grinding area is collected by a collecting mechanism and abrasive grains are reclaimed from the collected slurry by an abrasive grain recovery system for recycling, later described.

In the case of the chamfering by means of an apparatus of the present invention with loose abrasive grains as described above, for example GC # 1200 of green Carborundum, it has been confirmed that a dispersion of penetration depths of cracks on a crack layer across a ground surface is in the range of 6 to 12 $\mu$m and the dispersion is smaller, as compared with the case where a grinding stone of fixed abrasive grains of SD # 1200 of synthetic diamond is used for chamfering, when a spread of penetration depths of cracks in a crack layer across a ground surface is resulted in the range of 6 to 20 $\mu$m.

FIG. 3 shows a different cross-sectional profile of the periphery shaping edge 8*a* of a polisher 8.

In this case, for example, an upper corner of the periphery of a wafer W and a lower corner thereof are chamfered in different timing from each other. In more detail, by a combination of a movement of a polishing device 2 in a radial direction and a vertical movement of a clamp device 1, for example, as shown by an arrow (1), the polishing device 2 is moved so that the periphery of the wafer W and the periphery shaping edge 8*a* reach a position close to each other, then, as shown by an arrow (2), the polishing device 2 is relatively moved down (the clamp device 1 is moved up) to chamfer the upper corner of the periphery of the wafer W, then, as shown by an arrow (3), the polishing device 2 is relatively moved up (the clamp device 1 is moved down) to chamfer the lower corner of the periphery of the wafer W, and after completion of the chamfering, as shown by arrows (4) and (5), the polishing device 2 is brought back to its original position to be released from the working condition.

In such a profile of the periphery shaping edge, if the profile is changed due to wearing over time, for example, the edge can be repaired or corrected and besides, chamfering can efficiently be conducted, since slurry can be supplied being focused on a narrow area in chamfering.

FIG. 4 shows an internal structure of a polishing device 2, wherein a plurality of slurry paths t are formed in the interior of the polishing device 2 and such a structure is used in lieu of the slurry nozzle 3. FIG. 4(A) is a plan view and FIG. 4(B) is a sectional view in a direction of thickness. In this case, the rotary shaft 9 and core disc 7 of FIG. 1 are formed in a hollow structure and the hollow structure is used as a route for supplying slurry and the slurry is supplied toward the periphery shaping edge 8*a* through a plurality of paths t in the polisher 8 radiating in a plurality of directions from the center.

In the same case, it is advantageous that an apparatus for the chamfering can be designed to be compact spacewise, and the paths t for supplying the slurry are integrally built in the polishing device 8 and, therefore, a special moving mechanism for moving the slurry supply mechanism is not necessary.

FIGS. 5(A) and 5(B) show a structure of a periphery shaping edge 8*a*, which has a plurality of slits s cut along the periphery at a predetermined distance between adjoining two slits, wherein FIG. 4(A) is a plan view and FIG. 4(B) is a sectional view in a direction of thickness. In this case, the slits are used to force the used slurry to escape therethrough to make the chamfering effected with fresh slurry all the time by facilitating replenishment of new slurry.

In the above mentioned method of chamfering, a plurality of wafers W may be disposed along the periphery of the polisher 8 and the wafers W are chamfered all concurrently or one by one in succession. That is, each of the wafers W can be individually movable in a radial direction by the first moving mechanism and the wafers W are singly or some at the same time moved to the periphery shaping edge 8*a* so as to be chamfered in the presence of slurry.

FIG. 7 shows a second polishing device 8, which has a different shape in order to broaden a contacting area of the periphery of a wafer W in chamfering. That is, the second polishing device 8 has a concave circular arc portion 8*c* in conformity with the peripheral curvature of the wafer W to be chamfered, a periphery shaping edge 8*a* is formed on a peripheral surface of the concave circular arc portion 8*c* and a plurality of slurry paths t are directed to the periphery shaping edge 8*a* with openings of the paths t on the edge surface.

When chamfering is effected with the second polishing device 8, the periphery of a wafer W is moved close to the circular arc portion 8*c* and chamfering is conducted while the slurry is supplied through the slurry paths t and the wafer W is rotated. In this situation, if the polishing device 8 is of a circular shape, chamfering is conducted almost at a point on the periphery of the wafer W, but with this second polishing device 8, a broad contacting area is available by the circular arc portion 8*c* to enjoy chamfering with higher efficiency. A slurry supply means for supplying the slurry to the circular arc portion 8*c* may naturally be a slurry supply nozzle, but the plurality of slurry paths t are more suitable for supplying the slurry uniformly over the whole working area.

As described before, used slurry is collected by a collecting mechanism, not shown, and abrasive grains are reclaimed from the collected used slurry by a separation/recovery process. A common fluid cyclone classifier as shown in FIGS. 8(A) and 8(B) is used for this separation/recovery process, wherein FIG. 8(A) is a schematic diagram illustrating an internal structure and its function, as viewed from a side and FIG. (B) is a schematic diagram illustrating an internal structure and its function, as viewed from above.

This fluid cyclone classifier 10 comprises a cylindrical portion 10*a* and a conical portion 10*b*. The slurry is fed in a tangential direction of the cylindrical portion 10*a* to classify grains in the slurry by the help of a revolutionary flow. Coarser grains are discharged from the bottom in a concentrated slurry and finer grains are carried out on a rising stream in the conical portion to escape from an upper exit port 10*c*.

When abrasive grains with a predetermined size distribution are recovered, they are again suspended in a grinding fluid for recycling. If used abrasive grains are repeatedly recycled in such a way, the whole chamfering process becomes more efficient.

It should be strictly understood that the present invention is not restricted to the above mentioned embodiments. The above mentioned embodiments are given only exemplary and various changes and modifications thereof may fall within the technical scope of the present invention as far as they essentially have the same constitution as that of the technical concept recited in the appended claims of the present application and the functions and effects also are essentially the same as those of the appended claims.

As described above, the present invention is that a periphery shaping edge having a desired sectional profile along the periphery of a polisher is formed, chamfering of the periphery of a wafer is conducted in such a manner that grinding may be effected with a so-called formed tool, while the periphery of the wafer is relatively moved close to the periphery shaping edge and both are then moved in a different way relative to each other in the presence of slurry therebetween. With such chamfering, a stabler chamfering can be effected, as compared with chamfering with fixed abrasive grains and thereby, dispersion in penetration depth of cracks in a crack layer across a chamfered surface can be diminished and, in other word, areal fluctuation of the quality of a wafer can be reduced. Besides with a polisher having a periphery shaping edge of a circular arc shape, as in the second aspect, whose curvature is in conformity with that of the wafer, a broader area can concurrently be chamfered for better efficiency.

Moreover, as in the third aspect, if a wafer rotating mechanism, which rotates the wafer about its central axis, and a polisher rotating mechanism, which rotates the polisher about its central axis, are combined as the second relative moving mechanism, all the periphery of the wafer is chamfered in a shorter time with higher efficiency and no imbalanced abrasion occurs on the working surface of the periphery shaping edge.

As in the fourth aspect, if slits encouraging the escape of slurry in the working area, are formed along the periphery shaping edge at a constant distance between a pair of adjoining slits, chamfering is effected with fresh slurry all the time to increase a working efficiency.

As in the fifth aspect, if a slurry supply nozzle externally disposed is used as a slurry supply mechanism, the mechanism can be simpler in structure and the cost of manufacturing is lowered. As in the sixth aspect, if slurry paths formed within the polisher are used instead, more effective utilization of a space can be attained to make the apparatus more compact.

As in the seventh and eighth aspects, if used slurry is collected and abrasive grains are reclaimed through a separation/recovery process and the reclaimed abrasive grains are recycled, the chamfering process is more efficient.

Besides, as in further aspect, if chamfering is effected in combination of a single polisher and a plurality of wafers disposed in a manner to surround the polisher, chamfering of the wafers become more efficient.

What is claimed is:

1. An apparatus for chamfering a periphery of a wafer with loose abrasive grains, which comprises:

a polisher including a circular periphery in outward appearance, and a periphery shaping edge formed on the circular periphery, said periphery shaping edge having a desired cross-sectional profile;

a first relatively moving mechanism which moves the polisher and the wafer relatively away from or toward each other in a radial direction of the wafer so as to move the periphery shaping edge relatively away from or toward the periphery of the wafer;

a slurry supply mechanism for supplying slurry containing suspended abrasive grains at a closest position between the polisher and the wafer; and a second relatively moving mechanism which moves the polisher and the wafer relatively to each other in a tangential direction at the closest position to each other with the slurry being disposed between the polisher and the wafer so as to chamfer the periphery of the wafer with loose abrasive grains.

2. An apparatus for chamfering a periphery of a wafer with loose abrasive grains according to claim 1, wherein the slurry supply mechanism is a slurry supply nozzle disposed near both of the periphery shaping edge and the periphery of the wafer.

3. An apparatus for chamfering a periphery of a wafer with loose abrasive grains according to claim 1, wherein the slurry supply mechanism comprises slurry paths formed in the polisher and directed toward the periphery shaping edge, and the paths having openings at the periphery shaping edge.

4. An apparatus for chamfering a periphery of a wafer with loose abrasive grains according to claim 1, further comprising an abrasive recovery system that collects used slurry fed from the slurry supply mechanism and recovers loose abrasive grains in a collected slurry by separation to re-cycle the recovered loose abrasive grains as a suspension in a grinding fluid.

5. An apparatus for chamfering a periphery of a wafer with loose abrasive grains according to claim 4, wherein the abrasive recovery system is a fluid cyclone classifier.

6. An apparatus for chamfering a periphery of a wafer with loose abrasive grains according to claim 1, further comprising a third relatively moving mechanism which moves the polisher and the wafer relatively toward or away from each other in a vertical direction.

7. An apparatus for chamfering a periphery of a wafer with loose abrasive grains, which comprises:

a polisher including an outer periphery, a concave circular arc portion on the outer periphery in conformity with the curvature of a wafer to be chamfered, and a periphery shaping edge formed on an outer peripheral side surface, said peripheral shaping edge has a desired cross-sectional profile;

a first relatively moving mechanism which moves the polisher and the wafer relatively away from or toward each other in a radial direction of the wafer so as to move the periphery shaping edge relatively away from or toward the periphery of the wafer;

a slurry supply mechanism for supplying slurry containing suspended abrasive grains at a closest position between the polisher and the wafer; and a second relatively moving mechanism which moves the polisher and the wafer relative to each other with the slurry disposed between the polisher and the wafer so as to chamfer the periphery of the wafer with loose abrasive grains.

8. An apparatus for chamfering a periphery of a wafer with loose abrasive grains according to claim 1, wherein the second relatively moving mechanism comprises at least one of a wafer rotating mechanism which rotates the wafer about a central axis of the wafer, and a polisher rotating mechanism which rotates the polisher about a central axis of the polisher.

9. An apparatus for chamfering a periphery of a wafer with loose abrasive grains according to claim 8, wherein a plurality of slits are formed at a constant distance between a pair of adjoining slits of the plurality of slits along the entire outer peripheral length of the periphery shaping edge so as to facilitate escaping off of used slurry on the periphery shaping edge.

10. An apparatus for chamfering a periphery of a wafer with loose abrasive grains according to claim 7, wherein the second relatively moving mechanism comprises at least one of a wafer rotating mechanism which rotates the wafer about a central axis of the wafer, and a polisher rotating mechanism which rotates the polisher about a central axis of the polisher.

11. An apparatus for chamfering a periphery of a wafer with loose abrasive grains according to claim 10, wherein a plurality of slits are formed at a constant distance between a pair of adjoining slits of the plurality of slits along the entire outer peripheral length of the periphery shaping edge so as to facilitate escaping off of used slurry on the periphery shaping edge.

12. An apparatus for chamfering a periphery of a wafer with loose abrasive grains according to claim 2, wherein the slurry supply mechanism is a slurry supply nozzle disposed near both of the periphery shaping edge and the periphery of the wafer.

13. An apparatus for chamfering a periphery of a wafer with loose abrasive grains according to claim 7, wherein the slurry supply mechanism comprises slurry paths formed in the polisher and directed toward the periphery shaping edge, and the paths having openings at the periphery shaping edge.

14. An apparatus for chamfering a periphery of a wafer with loose abrasive grains according to claim 2, further comprising an abrasive recovery system that collects used slurry fed from the slurry supply mechanism and recovers loose abrasive grains in a collected slurry by separation to re-cycle the recovered loose abrasive grains as a suspension in a grinding fluid.

15. An apparatus for chamfering a periphery of a wafer with loose abrasive grains according to claim 14, wherein the abrasive recovery system is a fluid cyclone classifier.

16. An apparatus for chamfering a periphery of a wafer with loose abrasive grains according to claim 7, wherein the second relatively moving mechanism moves the polisher and the wafer relatively toward or away from each other in a vertical direction.

17. A method for chamfering a periphery of a wafer with loose abrasive grains, comprising:

moving a wafer so that a periphery of the wafer is positioned close to a periphery shaping edge of a polisher having a desired section profile, the periphery shaping edge being formed on an outer peripheral side surface of the polisher;

supplying a slurry containing suspension of loose abrasive grains to a space between the periphery shaping edge and the periphery of the wafer; and effecting relative movements between the periphery shaping edge and the periphery of the wafer with the slurry disposed in the space so as to chamfer the periphery of the wafer with loose abrasive grains.

18. A method for chamfering a periphery of a wafer with loose abrasive grains according to claim 17, further comprising positioning a plurality of wafers along the periphery of the polisher in a surrounding relationship and chamfering the plurality of wafers concurrently or one by one in succession.

19. The method for chamfering a periphery of a wafer with loose abrasive grains according to claim 17, wherein the relative movements between the periphery shaping edge and the periphery of the wafer include relative radial movements, relative vertical movements, and relative tangential movements, between the periphery shaping edge and the periphery of the wafer.

* * * * *